United States Patent [19]

Classen

[11] 4,155,126

[45] May 22, 1979

[54] UNIVERSAL HOSPITAL CHAIR

[76] Inventor: Henry Classen, P.O. Box 773, Upper Lake, Calif. 95485

[21] Appl. No.: 877,493

[22] Filed: Feb. 13, 1978

[51] Int. Cl.[2] ..... A47K 11/02; A47K 17/02; A47C 7/00; A47B 83/02

[52] U.S. Cl. ..... 4/134; 297/153; 297/367; 297/433; 297/440

[58] Field of Search ..... 4/134, 185 S, 237; 297/5, 6, 29, 130, 134, 149, 153, 345, 367, 369, 423, 433, 440, 434, DIG. 4

[56] References Cited

U.S. PATENT DOCUMENTS

| | | | |
|---|---|---|---|
| 2,591,911 | 4/1952 | Block | 297/422 X |
| 2,679,283 | 5/1954 | Mahone | 297/422 X |
| 2,738,001 | 3/1956 | Drabert | 297/422 X |
| 2,834,404 | 5/1958 | Groome | 297/345 |
| 2,866,495 | 12/1958 | Diehl et al. | 297/6 |
| 2,937,694 | 5/1960 | Willson et al. | 297/153 |
| 3,215,469 | 11/1965 | Warnsley | 297/130 X |
| 3,258,291 | 6/1966 | Ezquerro | 297/153 |
| 3,393,941 | 7/1968 | Grosfillex | 297/440 |
| 3,542,419 | 11/1970 | Spinola | 297/345 X |
| 3,567,275 | 3/1971 | Bukey | 297/423 X |
| 3,917,312 | 11/1975 | Rodaway | 297/130 X |
| 3,931,996 | 1/1976 | Yoshimura | 297/367 X |
| 4,054,315 | 10/1977 | Czarnowski | 297/153 |
| 4,065,175 | 12/1977 | Perego | 297/345 X |

*Primary Examiner*—Stuart S. Levy
*Attorney, Agent, or Firm*—Erik M. Arnhem

[57] ABSTRACT

A universal hospital chair comprising a first angular support frame with multiply apertured vertical sections; a second support frame, including a U-shaped vertical insert means having apertures aligning with those of the first support frame for assembly therewith to form a stand, a seat with rails terminating in ratchet receiving means, mountable adjustably within the apertured vertical sections of the assembled support frames; a back portion terminating in ratchet means adjustably mountable within said ratchet receiving means; a horizontal frame, with stand attachable to the seat portion; a toilet seat with insertable bowl optionally mountable within the apertured vertical sections of the assembled support frames; optional extensible leg rests, mountable to the seat portion; a table adjustably mountable within the apertures of the first support frame; the assembled support frames terminate in castors, respectively wheels, and upholstery means covering parts of the chair.

13 Claims, 9 Drawing Figures

UNIVERSAL HOSPITAL CHAIR

BACKGROUND OF THE INVENTION

1. Field of the Invention

The invention refers to a universal hospital chair with its back, seat and leg portions easily adjustable to almost any conceivable useful positions and equipped with alternately usable quickly attachable and detachable leg and foot rests, adjustable table and toilet seat.

2. Prior Art

The following U.S. patents were developed in a prior art search:

(1974); 3,795,923; Thomas
(1977); 4,028,749; James
(1968); 3,393,941; Grosfillex
(1956); 2,738,001; Drabert
(1953); 2,644,506; Pollack
(1961); 2,968,338; Reese
(1961); 2,971,567; Kimmel
(1974); 3,829,908; Thomas None of the above cited references appear to have any relevant structual similarity to the totality of health care purposes of my invention, or parts thereof. Drabert discloses a reclining chair for invalids including a stand or base portion comprised of two spaced bars, interconnected and supported by cross bars and a seat base which may be removable mounted thereon. Grosfillex discloses a chair comprised of a tubular metal frame having a detachable one piece seat.

The remaining references are of general interest.

SUMMARY OF THE INVENTION

It is the object of the invention to provide a universal hospital chair, which within seconds is adjustable, and convertible to function as various types of health care and service equipment, usable at hospitals, convalescent and private homes.

It is a further object of the invention to provide a universal hospital chair, that due to its safe and unique construction embodies and replaces a number of conventionally and individually designed pieces of health care equipment, as will be explained hereinafter.

It is still a further object of the invention to provide a universal hospital chair which — despite its variable functions — is of a rather simple construction and relatively inexpensive to manufacture, especially when considering the high cost of individual units of hospital equipment, which the invention incorporates.

The invented chair is constructed to provide maximum and safe comfort to people having back and leg problems; arthritis sufferers, invalids undergoing physical therapy treatments, etc.

The chair, according to the invention, basically comprises two assembled support frames, to which a seat portion may be attached at adjustable height levels, an adjustable back portion mountable to the seat portion, optionally usable foot and leg rests or support; a toilet seat; and a table adjustably mounted to a support frame.

Thus, in conjunction with a leg rest, according to the invention, the chair may be converted into a reclining chair, massage table, emergency bed, examining table for clinics and obstetric offices, etc.

A table, according to the invention can be snapped on to the front support frame of the chair at variable required heights providing a comfortable table for serving of meals, as a support when writing, etc. When the invention is used as a chair, its seat portion may be adjusted to any required height, thus, even into a highchair for little people.

A special leg support is easily attachable to and detachable from the front portion of the seat, and variably adjustable, ranging from a downwardly sloping position to a substantially vertical position; it will ideally serve people with feet, leg and back problems, in post-surgical care, etc.

Furthermore, the chair may be used in administering physical therapy to patients; the seat and back of the chair may then be adjusted to variable positions for that purpose and for restoring back problems to normalcy without surgery.

Finally, a toilet seat with a removable water containing bowl may be inserted within the support frames of the chair at any convenient height and even angularly tilted.

All the components and accessories of the invented chair are so designed, that they may be utilized interchangably, and adjusted for use in the course of a few seconds.

DESCRIPTION OF THE PREFERRED EMBODIMENT

Figure 1:
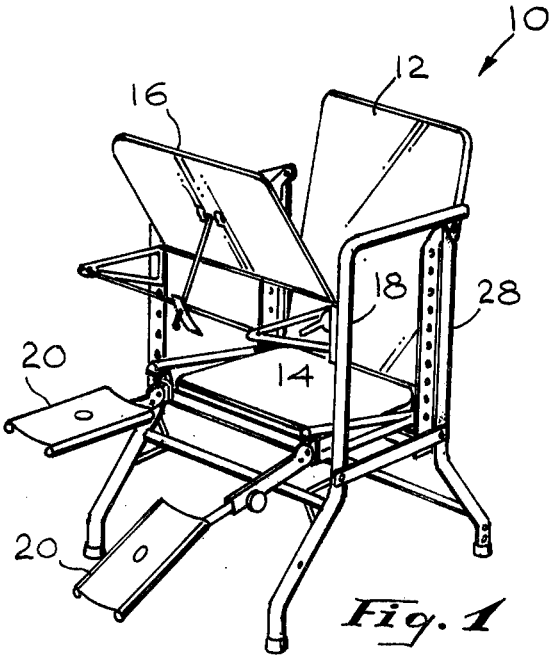
FIG. 1 is a perspective front view of the chair with mounted leg support and table attachments.

In the drawings like reference characters designate similar parts in the several views of the invention.

In FIG. 1, number 10 indicates the assembled hospital chair with some of its attachments, namely the back portion 12 in upright position, the seat portion 14, mounted at normal seating level, table attachment 16 attached to the front support frame 18, and extensible leg support 20 mounted to the seat frame portion 14.

Figure 2:
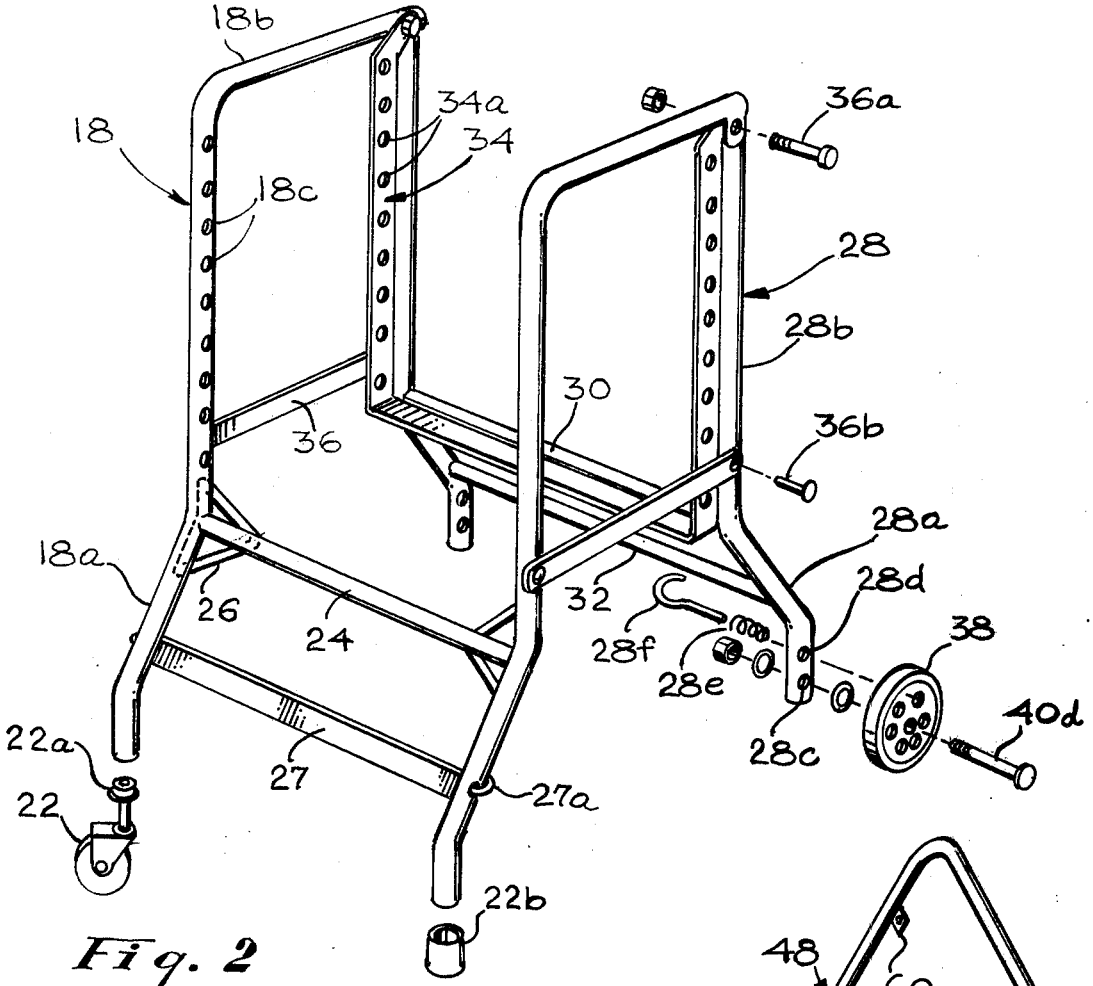
FIG. 2 is a perspective view of the dual support frames for the hospital chair.

FIG. 2 illustrates a detailed view of a first (front) angularly shaped support frame 18, comprising a pair of preferably out turned legs 18*a* extending into two substantially right angularly shaped sections 18*b*, arranged spatially relative one another, the vertical portions of which are provided, respectively with a series of aligned adjustment apertures 18*c*.

The support frames are preferably made of tubular steel. Two rotatable castors 22 (only one of which is shown) are tightly but removably fitted within the hollow ends of legs 18*a*, preferably by the intermediary of spacer 22*a* mounted thereto. The castors 22, when not utilized, are replaced by plugs 22*b* (one of which is only shown).

A front cross bar 24 bridges the support frame sections 18*b* and constitutes an integral part thereof.

A pair of preferably, triangularly shaped brackets 26 are reinforcingly mounted to and respectively interconnect the vertical portions and legs of support frame 18 and cross bar 24.

A strap section 27, preferably made of plastic material (such as vinyl) spans tightly between legs 18*a*, parallel to and below cross bar 24. Hook-like means 27*a* (only one of which is shown) are attached by any appropriate means to the ends of strap 27 and insterted removably into apertures provided therefor in legs 18*a*, serving as leg holders, when the chair is used for physical therapy. The patient may then place the legs inside strap 27 for example, while bending backwards.

A second (rear) support frame 28, consisting of a pair of, preferably outwardly turned legs 28*a*, extend into two vertical-sections 28*b*, arranged spatially relative one another.

Two cross bars 30 and 32 are integrally and reinforcingly bridging the two vertical and leg sections of support frame 28.

The free upper ends of the front and rear support frames 18, respectively 28 are rigidly mounted to one another, for example, by means of bolts and nuts 36*a*, to form the completely assembled tubular four legged support frame for a hospital chair, as indicated at FIG. 2. A U-shaped insert means 34 is mounted pivotally to the assembled support frame by means of the same bolts and nuts 36*a* as hold the upper ends of front and rear frame sections 18, 28 together.

A pair of cross bars 36 are mounted onto the external sides of and respectively, interconnect reinforcingly each of the oppositely arranged vertical portions of 18*b*, 28*b* of the front and rear support frames 18 and 28, by means of rivets, as indicated at 36*b*.

A pair of preferably rubber rimmed wheels 38 (one of which is only shown) is mounted to and secured, respectively, adjacent the end portion of the two tubular legs 28*a*, as will be explained now in the following:

A pair of (only one of which is shown) bolts 40*d* is, respectively inserted through the apertured center of wheels 38 (only one of which is shown) (constituting their axles) into crosswise penetrating bores or passages 28*c* in legs 28*a* (as indicated at 28*c*), and are securely fastened e.g., by means of nuts, washers and counter nuts, mounted tightly onto the other ends of bolts 40, permitting the free rotation of wheels 28, as schematically indicated on FIG. 2.

A second pair of bores 28*d* crosswise penetrating legs 28*a* is provided respectively, above apertures 28*c*, within which a pair of coil springs 28*e* (only one of which is shown) respectively, is frictionally inserted.

A pair of hook-like lock pins 28*f* (only one of which is shown) is respectively mounted movably within coil springs 28*e*.

Wheels 38 are provided with a number of peripheral apertures. When it becomes desirable to place the rotatable wheel 38 in braked or stationary position, one thrusts pin 28*f*, imbedded in coil spring 28*e* all the way through passages 28*d*, rotating it at approximately $\frac{1}{4}$ of a turn and into any of the peripheral apertures of respective wheels 38, thereby attaining a complete braking effect on the wheels.

When lock pins 28*f* are inserted within wheels 38, the hook-like part of pins 28*f* is caused to grip around legs 28*a*, supporting the braked state of wheels 38.

Figure 3:
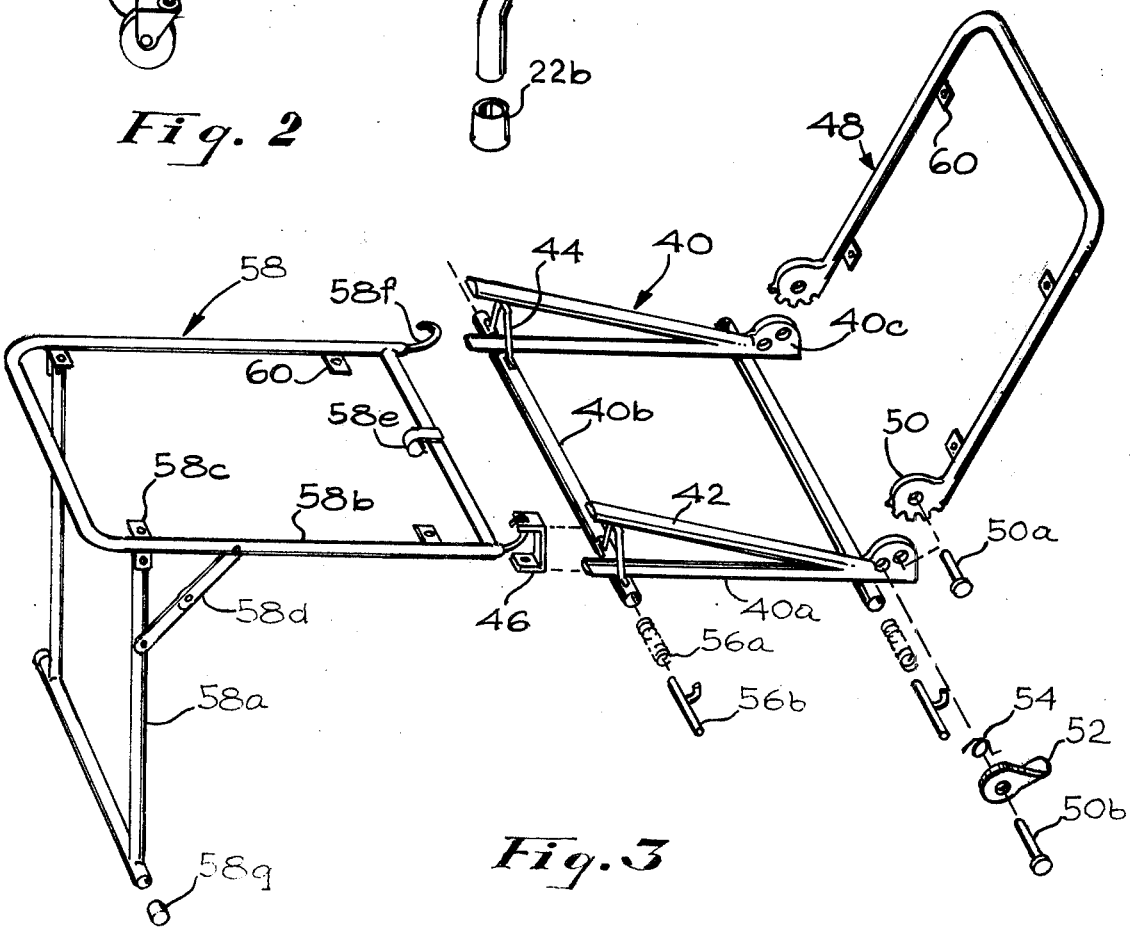
FIG. 3 is a detailed perspective view of an optional leg rest attachment, with back and seat portions of the chair, mountable on the support frames of FIG. 2.

FIG. 3 illustrates how the back, seat and an optional leg rest stand (detached from support frame 18, 28) are being interconnected. The seat frame basically consists of two pairs of tubular bars 40*a*, 40*b*, arranged spatially from and parallely with one another, to form a rectangular frame 40. The tubular bars 40*a*, 40*b* are interconnected by welding. The rear ends of bars 40*a* terminate in ratchet receiving means 40*c*.

A pair of rail members 42 (preferably made of carbon steel) are mounted to ratchet receiving means 40*c* and extend upwardly therefrom, overlying bars 40*a*. A pair of U-shaped brackets 44 is, respectively mounted between and at the free ends of rails 42 and bars 40*a* to reinforce said rails and bars.

A pair of apertured angular brackets 46 is mounted rigidly in front of and adjacent brackets 44, onto bars 40*a* and are intended to receive leg rest stand 58, the structure of which will be explained in detail further on.

A back portion 48 comprising a substantially inverse U-shaped tubular frame (preferably made of carbon steel) the two free ends of which terminate respectively, in a ratchet means 50, to be received by and mounted movably within ratchet receiving means 40*c*, by means of pairs of rivets 50*a*, (only one of which is shown as illustrated in FIG. 3.

Snapper or pawl means 52, intended for locking engagement with ratchet means 50, are, respectively mounted in ratchet receiving means 40*c* with spring means 54 by means of a pair of rivets 50*b*. Spring means 54 being so mounted therein, that they will support and hold pawl means 52 in locked position when engaging ratchet means 50, thus enabling one to adjust and retain back 48 at any required vertical, horizontal, reclining or forward positions, and maintain same rigidly therein relative to seat 40, until released by pawl means 52. The mounting of ratchet means 50 is shown schematically with only one rivet 50*b*, pawl 52 and spring 54 as illustrated in FIG. 3, the latter three components actually being part of the complete ratchet receiving means.

Seat frame 40 may be attached at any height level within aligned apertures of 18*c* of support frame 18 and 34*a* of insert means 34, to accomodate any required seating arrangements for patients, etc.

The corners of seat frame 40 are rigidly mountable within apertures 18*c* and 34*a* of support frame 18 and insert means 34 of frame 28, by means of lock pins 56*b*, inserted through said apertures and frictionally and releasably into spring means 56*a* within three free ends of seat frame bars 40*b*, respectively. The fourth rear corner end of frame 40 extends integrally into a pin insertable into one of the apertures of insert means 34, and thus lending support to seat 40, before mounting the other three ends thereof by means of lock pins 56*b*, as explained above. Thus the seat 40 may be snapped, within seconds, into the support frames 18, 28, as described above, and shown schematically in the drawing (in which only two sets of springs 56*a* and lock pins 56*b* are shown).

The leg rest 28, is preferably made of tubular steel bars and consists of a U-shaped upright leg stand 58*a*, hingedly connected to, and supporting the far end of substantially rectangular frame 58b by means of bracket means 58c.

The interconnection between leg stand 58a and horizontal frame 58b is further reinforced by hinged brackets 58d (only one of which is shown), the ends of which being e.g. riveted to and bridging the angular corner formed between them. Thus, leg rest unit 58 may be adjusted to any desirable position (FIG. 4) for the patient and is collapsible to save space, when not being used.

A flat steel spring 58e will securely hold leg stand 58a, and frame 58b in collapsed position, after being folded.

The two unattached corner ends of frame 58b are, respectively provided with hook-like means 58f, which are intended to snap into apertures in brackets 46, (only one of which is shown) and thus form one unit with seat and back portions 40, 48, all three sections of which are adjustable relative to one another.

The interior sides of back 48 and frame 58b are provided with a number of brackets 60 to which upholstery cover means (not shown on FIG. 3) are attached securely by any appropriate means, for the purpose of covering pertinent parts of chair 10.

A pair of plugs 58g (only one of which is shown) is, respectively insertable into the two open ends of the horizontal portion of leg stand 58a.

The back portion 48 may also be moved backwardly to lie flush with seat 40 and leg stand 58 and, thus be used as a massage table, bed, or accomodate patients in emergency rooms, etc.

Figure 4:
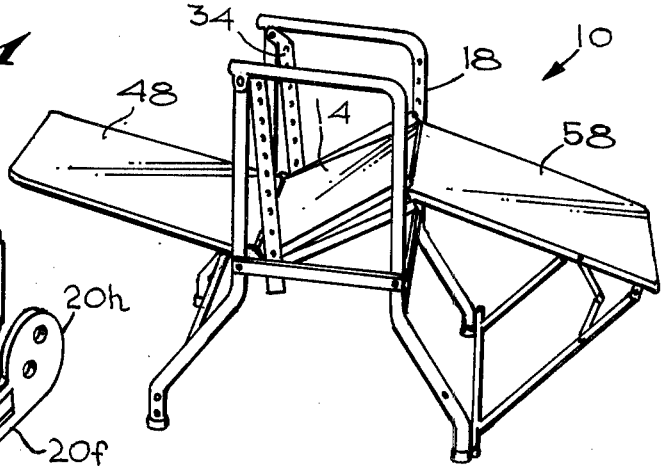
FIG. 4 is a perspective view of the chair with its back, leg rest and seat portions in an adjusted reclining position.

FIG. 4 illustrates the chair, according to the invention, with back, seat and leg rest sections 48, 14 and 58, respectively arranged in a particular angular position to one another, which ideally serves patients suffering from certain back ailments. Insert 34 (see also FIG. 2) onto which two of the rear corners of seat 14 are mounted, has been swung somewhat inwardly to permit the position of seat 14, as illustrated in FIG. 4.

Figure 5:
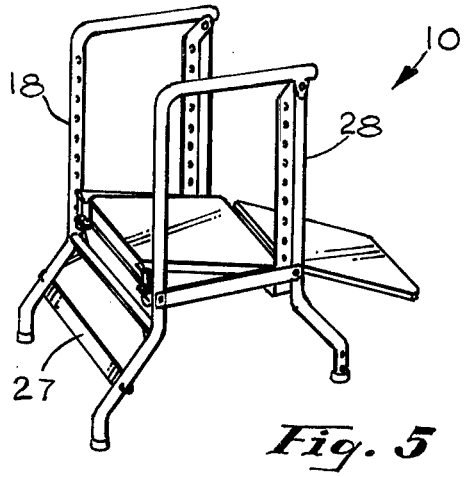
FIG. 5 is a perspective side view of the chair with its back and seat portions in a position usable for physical therapy in conjunction with the leg strap extending between the chairs front legs.

FIG. 5 shows the chair adjusted to a position in which physical therapy may be administered to patients. Where strap 27 is a leg holder for the patient, who undergoes physical therapy.

Figure 6:
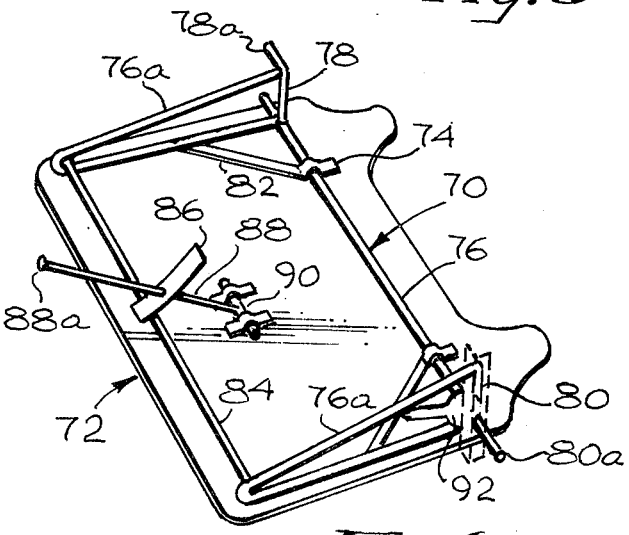
FIG. 6 is a detailed perspective view of the table attachment.

FIG. 6 illustrates a bottom view of table attachment 70, which snaps into the apertures of the front vertical portions 18b of support frame 18 and may be set at any height required by the patient, or even tilted up to 45 degrees, in order to hold reading material in a comfortable position, without support of the hands.

Table attachment 70 consists of a table leaf, its side adjacent the patient being shaped concavely for comfort; a set of brackets 74 is mounted spacedly onto the bottom side of table leaf 72 along its concave longitudinal side; a tubular support frame 70 is mounted rigidly but adjustably onto table leaf 72 by way of a first horizontal tubular section 76 (as part of frame 70) inserted rotatably within brackets 74 and extend at its respective ends angularly into two identical lateral sections 76a (along the side edges of leaf 72), returning downwardly sloping relative to the concave table leaf side, where they are united again with the end portions of the horizontal tubular section 76, by the intermediary, respectively, of two vertical spacing pieces 78, 80.

Two angularly shaped rods 82 are, respectively welded rigidly to and reinforcingly interconnect horizontal tubular section 76 with its returning lateral extensions 76a.

The ends of a second horizontal tubular section 84 are rotatable inserted by an appropriate means, respectively into the lateral sections 76a, adjacent the points of their intersection and parellel with horizontal section 76. An apertured curved piece 86 is mounted rigidly to and extend crosswise inwardly from the center portion of tubular section 84.

A T-shaped guid rod 88 is turnably mounted to the underside of table leaf 72, its horizontal section passing within brackets 90, which are rigidly fastened (e.g., by means of screws) to table leaf 72.

The vertical portion of T-shaped section 88 is slightly bent adjacent its mount and passes through and beyond the apertured cross piece 86, terminating in a knob-like protuberance 88a, the diameter of which is larger than that of the center hole of cross piece 86, and thus cannot escape therethrough.

The two ends of vertical spacing pieces 78, respectively extend into outwardly turned pin or hook portions 78a, which respectively are insertable into spaced apertures 18c of the support frame 18. (FIG. 1).

A small sleeve (not shown) is welded to the oppositely disposed vertical spacing piece 80 within which a handle (indicated at 92) is resiliently (e.g., by means of a spring not shown) accomodated, terminating in a hook or pin portion 80a, permitting the latter to be snapped into position within of the apertures of 18c of front support frame 18 (opposite the side into which hook portions 78a are inserted).

The table attachment may, thus be snapped into place (at any required level within the apertured vertical portions 18c of support frame 18, (and thus attach to the chair) by first inserting pin portions 78a therein and then, by depressing and releasing handle 92, causing pin portion 80a to also snap into place in support frame 18.

Cross piece 86 is intended as a handle, by which e.g., the patient may guide table leaf 72 into variable tilted positions and retain same therein, due to the pressure that curved cross piece 86 and T-shaped section 88 exert on one another.

One may also attach side tables (as newspaper racks, etc.) into each of the apertured sides of support frame 18, in addition to or instead of table 70.

Figure 7:
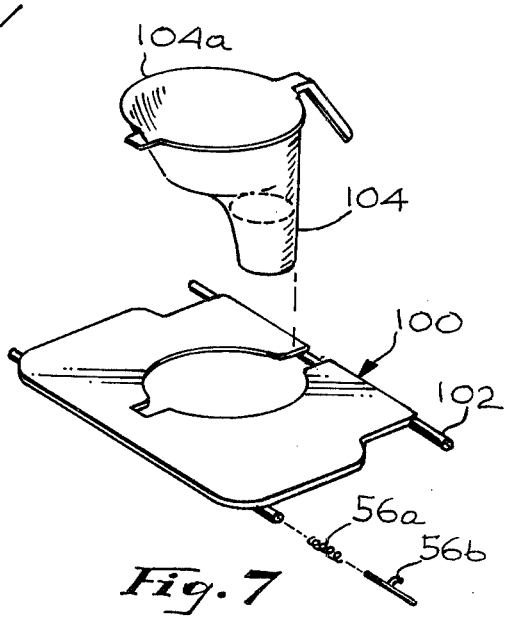
FIG. 7 is a front perspective view of a toilet seat mountable on the support frames of the chair, and a toilet bowl insertable therein.

FIG. 7 illustrates a toilet seat 100, having a centered opening, which, when required, may replace the regular seat 14 and is snapped into the apertures of the front support frame 18 and insert means 34 of support frame 28, by the same means as one used in mounting seat 14, that is by means of spring loaded lock pins 56a, 56b, passing through the apertures of the front and rear (insert means) support frames and tubuler sections 102 of toilet seat 100.

A bowl 104 provided with an upper projecting rim 84a is insertable into the opening of seat 100 and will rest with rim 104a on the peripheral area of the seat opening. Bowl 104, when in use, should contain a low level of water and will serve as a removable toilet bowl for the patient. The toilet seat may be mounted at any convenient height and even titled to accomodate the patient. The bowl 104 should be filled with approx. 1 qt. of water before inserted into seat 100. Support frames 18, 28 provide excellent hand support for the patient.

FIG. 1 illustrates, as mentioned above, an optionally usable pair of telescopically extensible leg supports 20.

Figure 8:
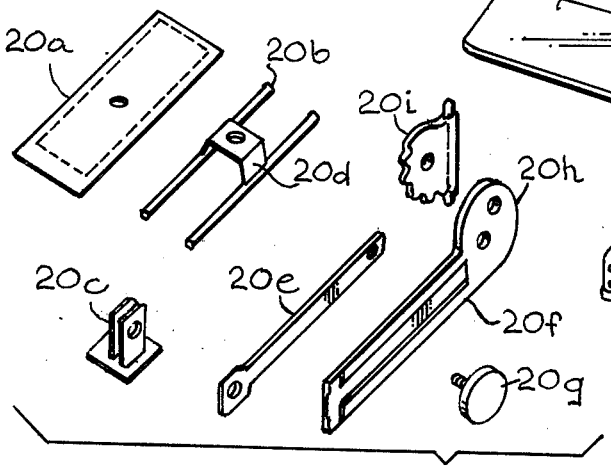
FIG. 8 illustrates in perspective views the basic components of the leg support attachment of FIG. 1.

The basic parts of leg supports 20 are also shown on FIG. 8, (showing in detail the working components of leg supports 20 of FIG. 1) and are in the following described in the singular, although obviously consisting of two identical units.

A slotted sleeve 20*f* terminates in a ratchet receiving means 20*h*. A ratchet 20*i* is movably locked within ratchet receiving means 20*h* by means of a spring loaded snapper or pawl (not shown on FIG. 8) but similar to the ratchet connections (52, 54, 50*a*, 50*b*) mounted between seat 14*a* and back 48 of FIG. 3). Ratchet 20*i* is integrally provided with a pin-like extension that is insertable into bracket 46 (FIG. 3) and is, thusly securely but rotatable into bracket 46 (FIG. 3) and is, thusly securely but rotatable attached to the seat frame section of the chair (FIG. 1).

A telescopic rod 20*e*, provided with one hole at their respective ends, is slid into the longitudinally slotted sleeve 20*f* and retained at various desirable points therein, by means of a adjusting screw 20*g*, which passes through the slot of sleeve 20*f* and into the hole (inside the sleeve) of rod 20*e*.

A knob (the diameter of which is larger than the width of the slot) of screw 20*g*, slides externally along the slotted portion of sleeve 20*f*. When screw 20*g* is tightened by turning the know), rod 20*e* may be fixedly retained at a desired length portion within and outside sleeve 20*f*.

A leg platform 20*a*, made of a folded piece of e.g. vinyl, within which reinforcing rods (not shown) may be sewn is mounted by any appropriate means to the top surface of underlying support means 20*b*, (seen from the bottom) consisting of two parallel rods and interconnecting apertured cross piece 20*d*. The flat bottom side of an apertured bracket 20*c* is rigidly mounted to cross piece 20*d* (e.g. by a screw connection passing through the hole of cross piece 20*d*).

Rod 20*e* is mounted pivotally within the forked portion of bracket 20*c*, by an appropriate fastening means passing through the hole of the outer end of rod 20*e* and the holes of forked bracket 20*c*.

The leg support 20 may, thus be placed at various vertical, horizontal, slanting and length positions compatible with the comfort and/or medical requirements of a patient.

One may, optionally, substitute a pair of foot supports for the leg supports 20, if this should become necessary for the convenience of the patient.

Figure 9:
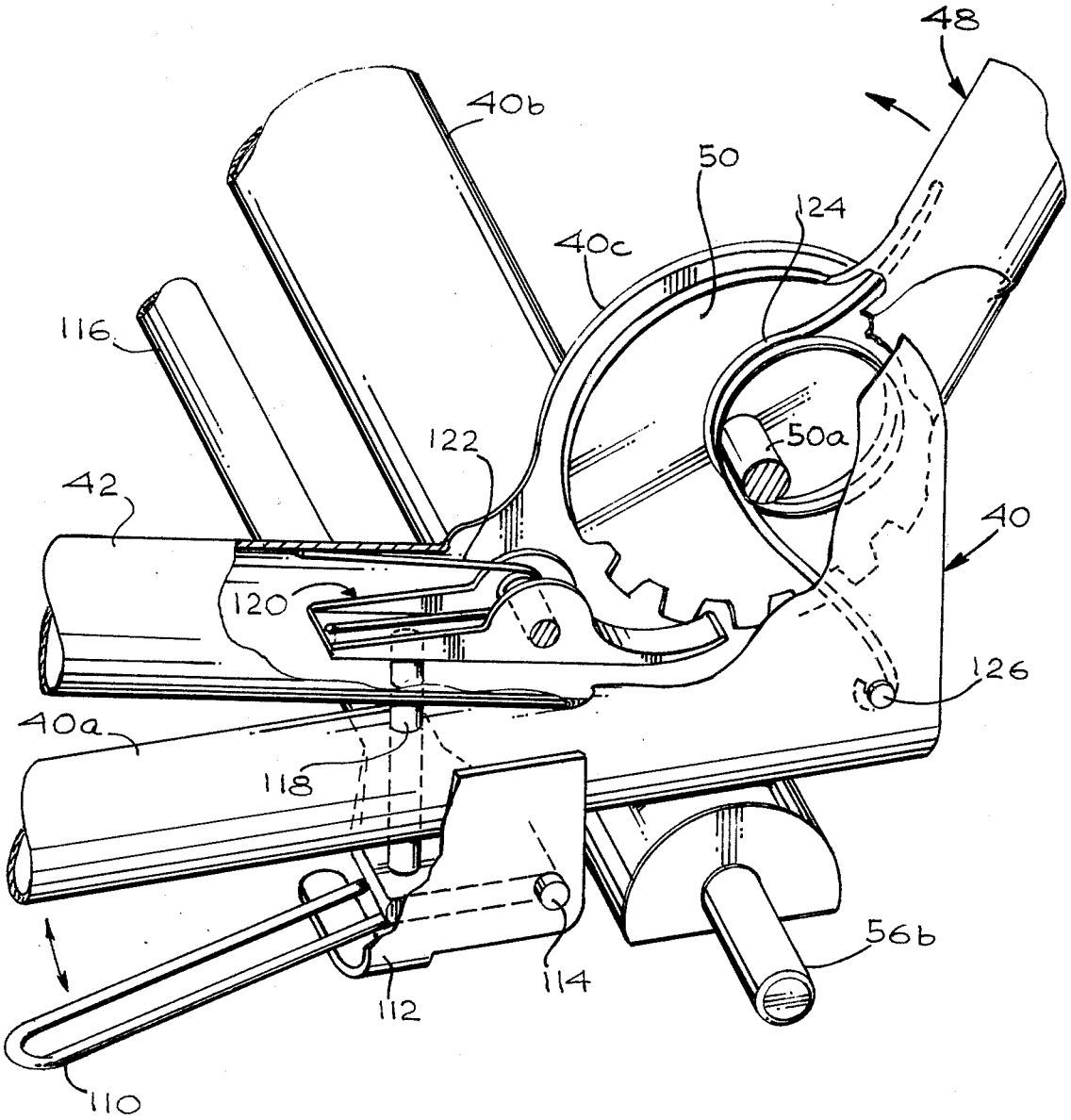
FIG. 9 is a partially sectional and perspective view of the ratchet connection between seat and back portions of the chair of FIG. 3, including an optional level mechanism that permits e.g., an invalid to release the engagement of the ratchets.

FIG. 9 illustrates, on an enlarged scale the assembled ratchet means of FIG. 3, permitting backward and forward retentive adjustment of the back 48, relative to the seat portion 40 of the chair. With a view to accomodate especially invalids, whose movements may be limited, I have invented an optional levering mechanism (as a supplement to the ratchet means) which will allow such patients to easily (and without turning or getting out of the chair) adjust the positions of the back portion of the chair.

The said levering mechanism comprises a levering rod 116, extending parallel to tubular bar 40*b*, terminating in a handle 110 (for the convenience of the patient). The levering rod 116 is mounted movably within two brackets; welded onto the two end portions of tubular bar 40*b*. The two ends of rod 116 extends vertically through apertures into tubular bar 40*b* bearing on vertically extending unattached plungers 118. When the handle 110 is pressed upwardly, it pushes plunger 118 upwardly which releases spring means 122 connected to and retaining pawl 120 within the teeth of rachet wheel 50; the effect is that pawl 120 disengages from the latter, permitting the patient to adjust the positions of the back portion of the chair. When the handle 110 is released, the action of spring means 122 will again revert to and cause the pawl 120 to engage with ratchet 50. A retraction spring means 124 is mounted within ratchet housing 40 by means of rivet 126 and extends around the rivet 50*a*. The function of spring 124 is to cause the back 48 to resiliently return from a rearward position, when the level mechanism has caused the disengagement of ratchet 50, as explained above.

For the sake of clarity FIG. 9 only shows a portion of the levering rod 116 with one plunger 118, the chair, obviously, is equipped with a pair of plungers each of which is performing the functions, in conjunction with the ratchet mechanism, as explained above.

While the foregoing has illustrated and described what is now contemplated to be the best mode of carrying out the invention, the description is, of course, subject to modifications without departing from the spirit and scope of the invention. Therefore, it is not desired to restrict the invention to the particular constructions illustrated and described, but to cover all modifications that may fall within the scope of the appended Claims.

I claim:

1. In a hospital chair, comprising:

(a) a first support frame having a multiplicity of aligned apertures;

(b) a second support frame for assembly with the first support frame to form a stand;

(c) an insert means, mounted pivotally at and relative to the first and second support frames, having a multiplicity of aligned apertures, which when so mounted will substantially align with the apertures of the first support frame;

(d) a seat means mounted adjustably within the apertures of the first support frame and insert means;

(e) bracket means mounted to the front portion of the seat means;

(f) a leg rest frame mounted at and adjustably relative to the seat means;

(g) a table means tiltably mounted within the apertures of the first support frame;

(h) upholstery means covering the seat means, and the leg support frame.

2. A hospital chair, according to claim 1, in which the first support frame comprises two legged substantially vertically disposed apertured tubular sections, respectively extending into horizontal sections, arranged spatially relative one another and interconnected by means of at least one cross bar.

3. A hospital chair, according to claim 1, in which the second support frame comprises two legged substantially vertically disposed tubular sections, arranged spatially relative one another, interconnected by means of at least one cross bar.

4. A hospital chair, according to claim 2 or 3, in which a resilient strap is mounted between the legs of the first support frame.

5. A hospital chair, according to claim 2 or 3, in which the legs of one of the support frames, respectively have an upper and lower bore within which an interlockable wheel mechanism is mounted, comprising, a peripherally apertured wheel; fastening means mounting the wheel rotatably in one of the bores; spring means mounted within the other bore; hook means mounted in the spring means for retractable penetration into one of the holes of the wheel.

6. A hospital chair, according to claim 1, in which the insert means comprises an apertured U-shaped tubular section, the free ends of which are mounted pivotally at the upper ends of and relative to the first and second support frames.

7. A hospital chair, according to claim 1, in which the seat means comprises one front and back and two lateral bars forming a rectangular frame; ratchet receiving means provided at the rear portion of the lateral bars; two rail members mounted, respectively adjacent the ratchet receiving means and extending angularly upward therefrom; two brackets mounted to and bridge the space between the free ends of the lateral bars and rail members; at least two spring means mounted, respectively within the ends of the front and back tubular bars; at least two lock pins, respectively insertable in said spring means for releasably mounting the seat means within the apertures of the first support frame and the insert means of the second support frame; an inversely U-shaped back portion, the two ends of which terminate in ratchet wheels for mounting releasably within the ratchet receiving means of the said lateral bars.

8. Levering means for the seat means, according to claim 7 for alternatingly mounting and interacting with the ratchet connections of the seat means of the chair, comprising bracket means mounted spatially relative one another on the rear bar of the seat means; a levering rod mounted movably within said brackets, handle means extending outwardly from and integrally with the levering rod, the two ends of the levering rod being turned upwardly extending through and into the lateral tubular bars of the seat means; plunger means, abutting the top of the upturned ends of the levering rod, which when lifted by means thereof, cause the ratchet pawl means to disengage from the ratchet wheel; a retraction spring mounted to an and co-acting with the ratchet wheel during the disengagement of the pawl; housing means within which the ratchet connections are enclosed and to which one end of the retraction spring is mounted.

9. A hospital chair, according to claim 1, in which the leg rest frame comprises a vertical U-shaped stand section, a horizontally disposed frame, one end of which is resting on the free ends of the U-shaped stand section; hinge brackets, foldably interconnecting the stand section and horizontal frame; hook means provided at the other end of the horizontal frame for mounting to the bracket means disposed at the front portion of the seat means.

10. A toilet means for the hospital chair, according to claim 1, alternatively mountable within the apertures of the first support frame and insert means of the second support frame, comprising a toilet seat having a centered opening; two spaced tubular sections mounted to the bottom side of the toilet seat; their respective ends projecting therefrom; spring means embedded within at least two of said tubular end sections; at least two lock pins mountable resiliently in said spring means for releasably mounting of the toilet seat within the apertures of the first support frame and the insert means of the second support frames; a bowl insertable in the opening of the toilet seat.

11. A table means, according to claim 1, comprising: a table leaf; first bracket means, mounted to the bottom side of the table leaf; two longitudinal tubular sections, arranged parallely and spatially relative one another, one of which is mounted rotatably within the first bracket means; two lateral tubular sections mounted, respectively to the ends of and interconnecting the longitudinal sections, one of said lateral sections extends into two spaced out turned pin means, insertable, respectively in apertures of the first support frame; a handle mounted resiliently to the other lateral section, extends into an out turned pin means for snapping into one of the apertures of the first support frame; an apertured cross piece mounted to and extending inwardly from the other longitudinal section; second bracket means mounted to substantially centered portion of the table leaf bottom; a T-shaped rod, the horizontal portion of which passes rotatably through the second bracket means; the free end of the vertical portion of said T-shaped rod passes through the aperture of the cross piece, terminating in a knob for guiding the table leaf within variable positions relative to its underlying support sections.

12. A pair of leg supports for the hospital chair according to claim 1, alternatively mountable to the seat, comprising, respectively ratchet means mountable to the bracket means of the seat means, slotted sleeve means terminating in ratchet receiving means, in which ratchet means is rotatably mounted; an extension rod apertured near its two ends sliding partially within the sleeve; a knobbed adjustment screw arranged slidable within and along the slot of the sleeve and into the aperture of the inner rod portion; a leg supporting frame having two parallel rods interconnected by a cross piece; a pad mounted on the top surface of the leg supporting frame; an apertured forked bracket, mounted to the bottom surface of the cross piece, within which the extension rod passes and is mounted hingedly therewithin by means of fastening means passing through the aperture of the forked bracket and the aperture of the outer portion of the extension rod.

13. A hospital chair, according to claim 1, in which two castors are, respectively mounted to the ends of the legs of one of the support frames.

* * * * *